United States Patent [19]

Haag et al.

[11] Patent Number: 4,850,525

[45] Date of Patent: Jul. 25, 1989

[54] PARKING TICKET

[75] Inventors: Robert A. Haag, Swansea; Leonard L. Ney, Jr., North Attleboro; Lambert J. Marcucci, Medford, all of Mass.

[73] Assignee: Dunbar-Wolfe Printing Company, Randolph, Mass.

[21] Appl. No.: 166,655

[22] Filed: Mar. 11, 1988

[51] Int. Cl.[4] ..... B65D 27/06

[52] U.S. Cl. ..... 229/73; 229/68 R

[58] Field of Search ..... 229/73, 70, 68 R, 69

[56] References Cited

U.S. PATENT DOCUMENTS

| | | | |
|---|---|---|---|
| 3,411,699 | 11/1968 | Pine et al. | 229/73 |
| 3,977,597 | 8/1976 | Wise et al. | 229/73 |
| 3,981,435 | 9/1976 | Johnsen | 229/73 |
| 4,002,290 | 1/1977 | Van Malderghem | 229/69 |
| 4,384,670 | 5/1983 | Dicker | 229/73 |

*Primary Examiner*—Willis Little

[57] ABSTRACT

A return mailer bearing computer readable information including a mailing panel of a first surface porosity, adapted to bear an address of a returnee, further including a folding sealing flap along one transverse edge that is adapted to form a transverse edge of the envelope when it is folded and sealed. Also included is an information panel of a second surface porosity, bearing machine readable information on at least one side, which includes two transverse perforations, wherein the perforations are separated by a longitudinal distance sufficient to span the portions of each side of the information panel bearing information of interest to the returnee. The two panels are joined by an adhesive along the two longitudinal segments of their periphery to form the two longitudinal edges of the envelope. The adhesive maintains the mailer in sealed condition during mailing, while not contributing to gnarling or tearing of either panel upon separating the two panels upon opening. The two panels are bonded along the transverse segment of their periphery distal to the sealing flap to form a transverse edge of the envelope. The panels remain bonded along this transverse edge upon tearing the information panel along both of the perforations.

8 Claims, 5 Drawing Sheets

PRIOR ART

PARKING TICKET

BACKGROUND OF THE INVENTION

This invention relates to perforated return mailers that incorporate machine readable data.

Perforated information mailers are known. Computer forms that might enclose additional forms and carbons, or forms adapted to act like carbons, are sealed about their periphery to define a mailing envelope. Perforations are provided to facilitate the opening and subsequent removal of only the form of interest from the envelope. The envelope itself is of no interest and is discarded.

Return mailers are also known, for example in the form of parking tickets. In the past, an errant motorist receiving a parking ticket was required to mail a payment using his own envelope. Compliance improved when the parking ticket was actually printed on one panel of a weather-resistant return envelope or mailer. The recipient of the ticket inserted a check and placed the envelope in the mail. Upon receiving the mailer, the processor removed the enclosed payment and separated the two panels of the mailer, retaining the panel with the ticket printed on it. If the panel included machine readable information such as the ticket number, it would then be scanned by an optical reader, and the motorist's debt would be cleared. One difficulty with this system arises when the two panels are separated, and the panels rip or gnarl, causing the reader to jam or read only a portion of the panel.

SUMMARY OF THE INVENTION

In general, the invention features a return mailer bearing machine readable information including a mailing panel of a first surface porosity adapted to bear an address of a returnee, which includes a folding sealing flap along one transverse edge that is adapted to form a transverse edge of the envelope when it is folded and sealed. Also included is an information panel of a second surface porosity, bearing machine readable information on at least one side, which includes two transverse perforations, wherein the perforations are separated by a longitudinal distance sufficient to span the portions of each side of the information panel bearing information of interest to the returnee.

The two panels are joined by an adhesive along the two longitudinal segments of their periphery to form the two longitudinal edges of the envelope. The adhesive maintains the mailer in sealed condition during mailing, while not contributing to gnarling or tearing of either panel when the two panels are separated upon opening.

The two panels are bonded along the transverse segment of their periphery, distal to the sealing flap, to form a transverse edge of the envelope. The panels remain bonded along this transverse edge upon tearing the information panel along both of the perforations.

In a preferred embodiment, the mailing panel is treated on at least one side with sizing, so as to provide a surface with a second surface porosity less than the first.

In additional preferred embodiments, the longitudinal panel segments are joined by an easy to separate but shear-resistant adhesive. The adhesive is applied to one of the panels within two long narrow regions along the two longitudinal segments of the periphery of the mailer.

In a further preferred embodiment, the adhesive is distributed along the longitudinal segments in a series of spaced dots.

In other preferred embodiments, one panel also serves to draw attention to the mailer by bearing an outstanding coloration, the mailer is adapted to be weather resistant, and is adapted for use as a parking ticket.

Other advantages and features will become apparent from the following description of the preferred embodiment and from the claims.

DESCRIPTION OF THE PREFERRED EMBODIMENT

We first briefly describe the drawings:

DRAWINGS

Figure 3A:
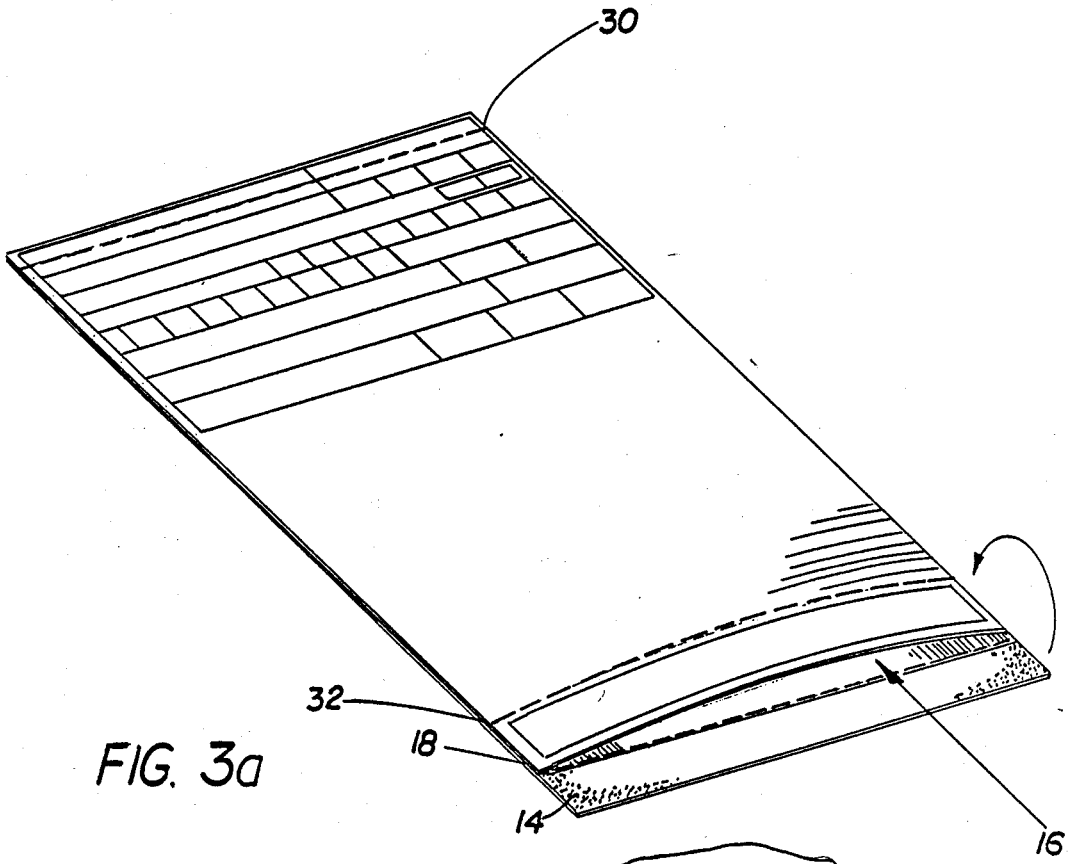
Figure 3B:
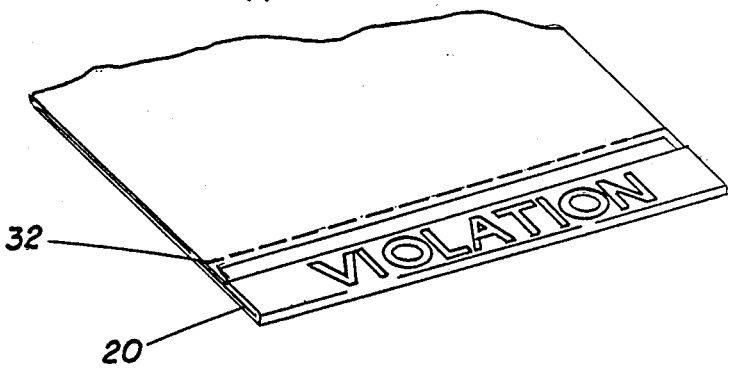

FIGS. 3*a* and 3*b* are schematic views illustrating the closing of the sealing flap.

Figure 4A:
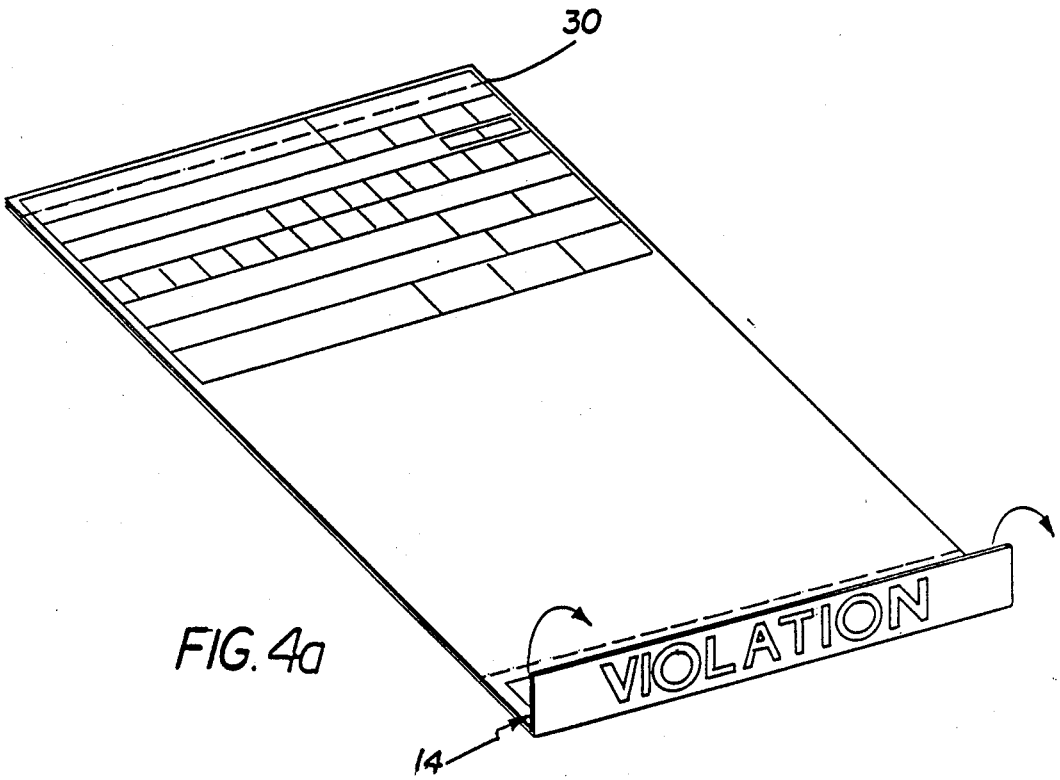
Figure 4B:
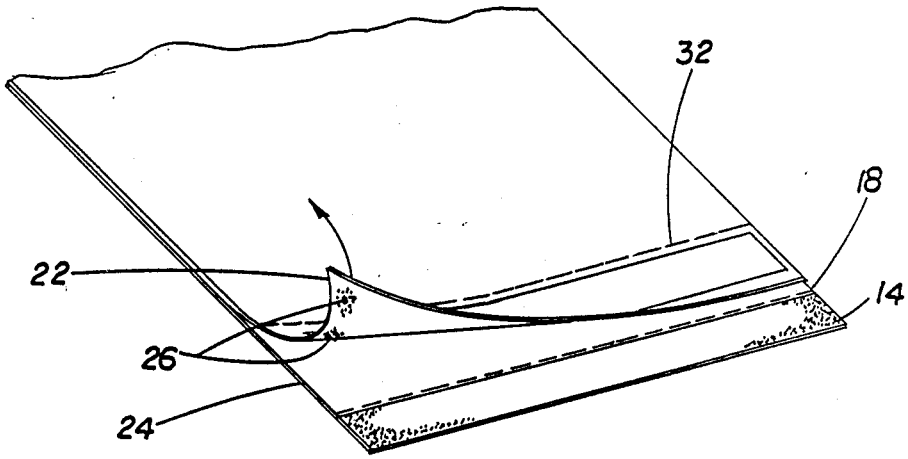

FIG. 4*a* and 4*b* are schematic views illustrating the opening of the sealing flap, and subsequent separation of the panels comprising the parking ticket.

Figure 5:
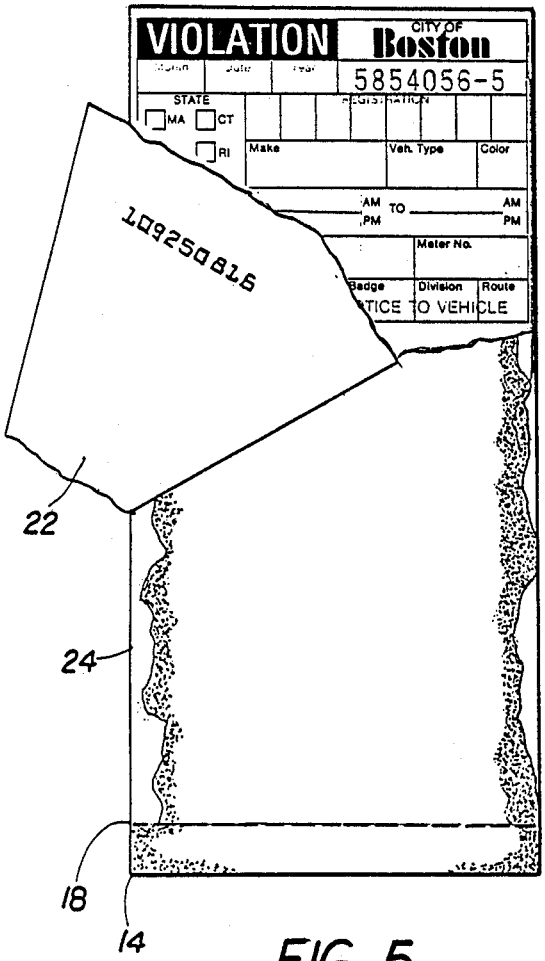

FIG. 5 is a view showing the prior art ticket being separated and ripped.

Figure 6:
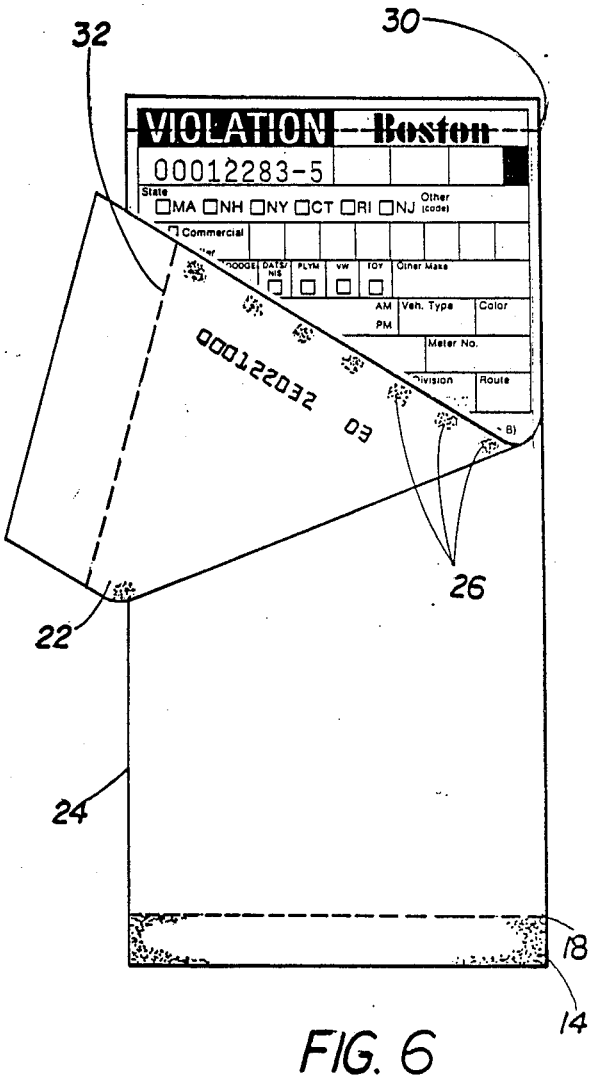

FIG. 6 is a view showing the ticket of the invention being separated.

Figure 7:
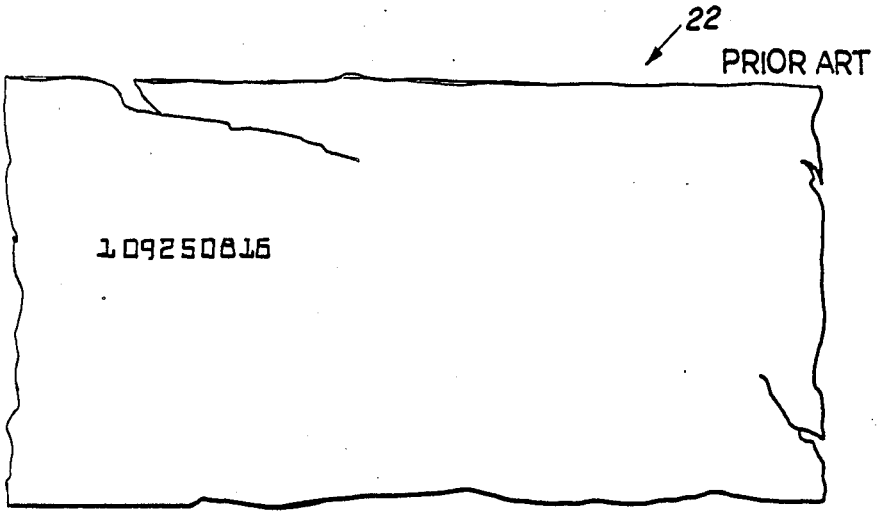

FIG. 7 is a view showing a ripped and gnarled prior art ticket panel after separation.

Figure 8:
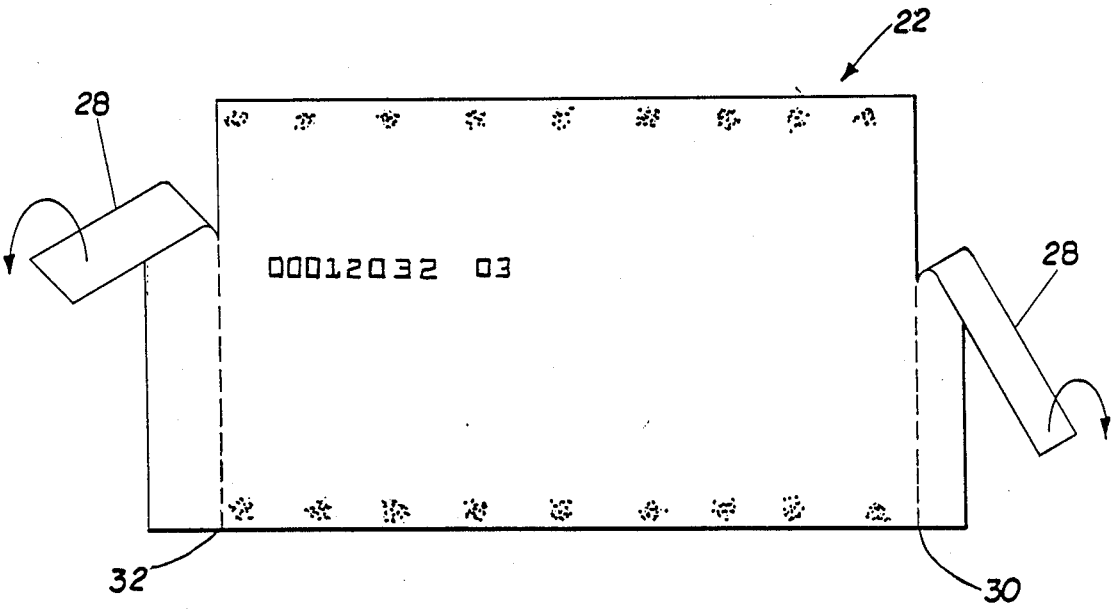

FIG. 8 is a view of the end tabs being neatly torn from the information panel to create two, clean, easily processable edges.

STRUCTURE AND USE

Figures 1, 2:
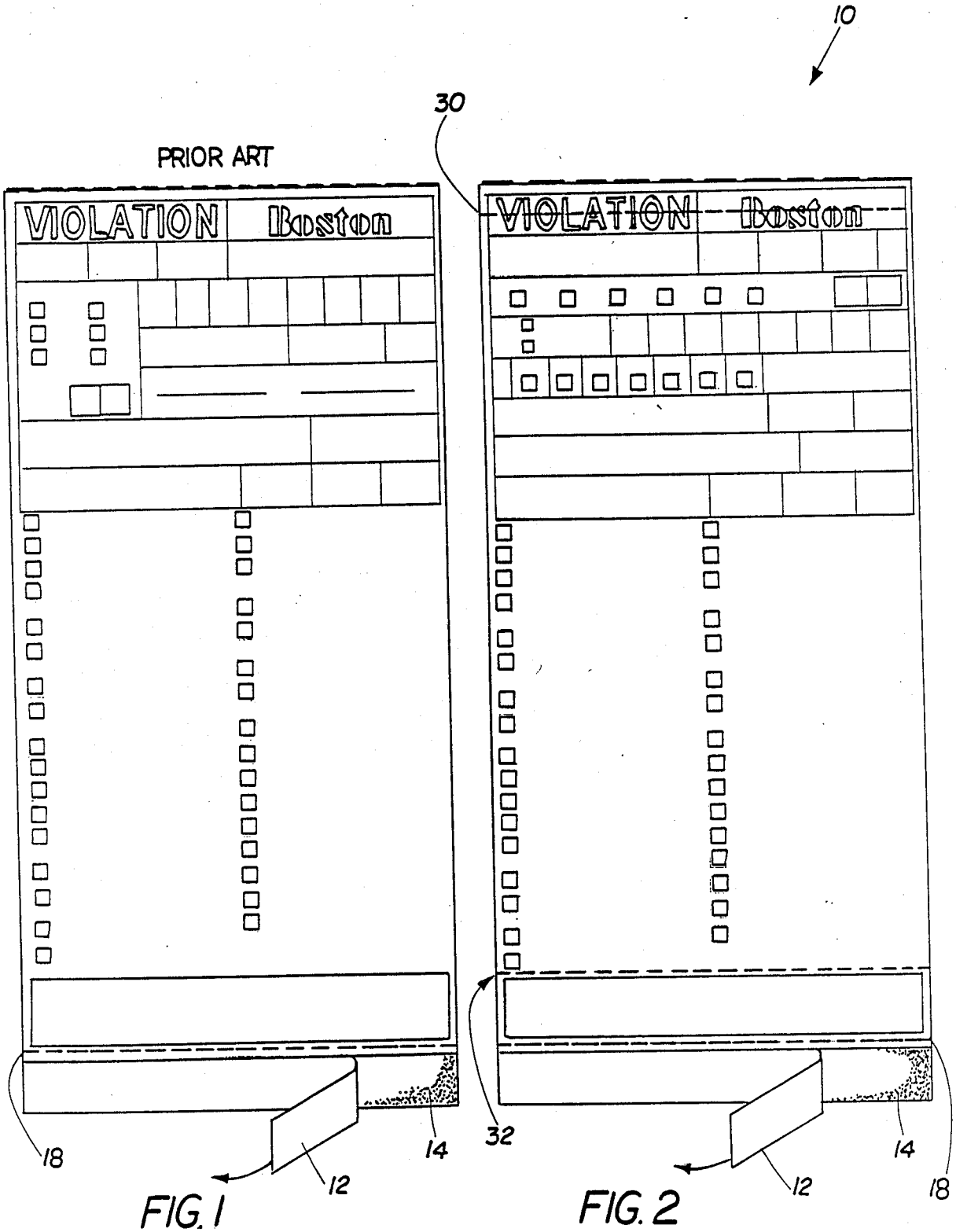
FIG. 1 is schematic view of a prior art parking ticket.
FIG. 2 is a schematic view of a parking ticket embodying the present invention.

A prior art ticket is shown in FIGS. 1, 5, and 7. As can be seen with reference to these figures, after the ticket has been received by the processor, the two panels are separated which can result in tearing which may jam an optical card reader attempting to read the encoded number on the information panel 22 as shown in FIG. 7.

A return mailer or parking ticket 10 according to the present invention is shown in FIGS. 2 and 3. After receiving a ticket, the motorist inserts a payment into the opening 16. Thereafter he peels away a protective strip 12 and folds a sealing flap 14 along a sealing flap perforation 18. Pressure is applied to the sealing flap to engage an adhesive to form an end 20 of the envelope.

Upon receipt of the return mailer 10 by a parking ticket processor, the sealing flap 14 is unfolded or cut, and an information panel 22 is peeled away from a mailing panel 24 as shown in FIGS. 4a and 4b. As stated above, the present invention allows the two panels to be separated without tearing or other damage so that the information panel 22 can be read by an optical reader without jamming it. To insure that the panels separate readily, they are held together by adhesive dots 26 as shown in FIG. 6. The size and spacing of the dots are selected so as to offer resistance insufficient to tear the panels during separation. To further insure that the panels separate without damage, the mailing panel 24 is treated on its inner side with sizing. The sizing makes the surface less porous, decreasing the penetration of the glue into the paper, thereby creating a difference in surface porosity between the information panel and the mailing panel. Thus, the adhesive dots are encouraged to remain affixed to the information panel, without ripping up paper fibers from the surface of the mailing panel.

Another important aspect of the present invention are the perforations 30 and 32 in the information panel 22. As shown in FIG. 8, after the panels are separated, end tabs 28 are separated from the information panel 22 along the perforations 30 and 32 leaving a neat, unripped, machine readable card-like piece of paper.

It is recognized that modifications and variations of the present invention will occur to those skilled in the art and it is intended that all such variations and modifications be included within the scope of the appended claims.

What is claimed is:

1. A return mailer bearing machine readable information comprising:

(a) a mailing panel, of a first surface porosity, adapted to bear an address of a returnee, including a folding sealing flap along one transverse edge, the sealing flap being adapted to form a transverse edge of the envelope upon folding and sealing the flap;

(b) an information panel, of a second surface porosity, different from said first surface porosity, bearing machine readable information on at least one side, including two transverse perforations, wherein the perforations are separated by a longitudinal distance sufficient to span the portions of both sides of the information panel bearing information of interest to the returnee;

(c) longitudinal panel joining means that bond the two panels along the two longitudinal segments of their periphery to form the two longitudinal edges of the envelope, the panel joining means being adapted to contribute to maintaining the mailer in sealed condition during mailing, while not contributing to gnarling or tearing of either panel upon separating the two panels while opening the mailer; and (d) transverse panel joining means that bond the two panels, along the transverse segment of their periphery that is distal to the sealing flap, to form a transverse edge of the envelope, and resist disjoining upon tearing the information panel along both of the perforations.

2. The mailer of claim 1, wherein the mailing panel is treated on at least one side with sizing so as to provide a surface of a second surface porosity less than the first.

3. The mailer of claim 1, wherein the longitudinal panel joining means comprises easy to separate but shear-resistant adhesive.

4. The mailer of claim 3, wherein the adhesive is applied to one of the panels within two long narrow regions laong the two longitudinal segments of the periphery of the mailer.

5. The mailer of claim 4, wherein the adhesive is distributed along the longitudinal segments in a series of spaced dots.

6. The mailer of claim 1, wherein one panel also serves to draw attention to the envelope by bearing an outstanding coloration.

7. The mailer of claim 1, wherein the mailer is adapted to be weather-resistant.

8. The mailer of claim 1, wherein the mailer is adapted for use as a parking ticket.

* * * * *